US008025300B1

(12) United States Patent
Jordan

(10) Patent No.: US 8,025,300 B1
(45) Date of Patent: Sep. 27, 2011

(54) SPORTS BOARD WITH REAR BRAKE

(76) Inventor: Christopher Jordan, Midwest City, OK (US)

( * ) Notice: Subject to any disclaimer, the term of this patent is extended or adjusted under 35 U.S.C. 154(b) by 149 days.

(21) Appl. No.: 12/583,442

(22) Filed: Aug. 20, 2009

(51) Int. Cl.
*B62M 1/00* (2010.01)

(52) U.S. Cl. ..... 280/87.042; 280/87.021; 280/87.041

(58) Field of Classification Search ..... 280/87.042, 280/11.22, 842, 11.28, 11.3, 11.31, 87.05, 280/11.216, 786; *B62M 1/00*
See application file for complete search history.

(56) References Cited

U.S. PATENT DOCUMENTS

| | | | | |
|---|---|---|---|---|
| 3,630,540 | A | 12/1971 | Smith | |
| 4,140,326 | A * | 2/1979 | Huber | 280/87.042 |
| 4,149,735 | A * | 4/1979 | Blackburn et al. | 280/87.042 |
| 5,096,225 | A | 3/1992 | Osawa | |
| 5,152,691 | A | 10/1992 | Moscarello | |
| 5,544,919 | A * | 8/1996 | Tinkler | 280/809 |
| 5,622,759 | A * | 4/1997 | Fuster | 428/40.2 |
| 5,645,291 | A | 7/1997 | Ramage | |
| 5,794,955 | A * | 8/1998 | Flynn | 280/87.042 |
| 6,199,881 | B1 * | 3/2001 | Wood et al. | 280/87.042 |
| 6,270,096 | B1 | 8/2001 | Cook | |
| 6,467,560 | B1 * | 10/2002 | Anderson | 180/181 |
| 6,698,776 | B2 | 3/2004 | Todd | |
| D498,810 | S | 11/2004 | Stanisewski, Jr. | |
| D505,463 | S | 5/2005 | Horkan et al. | |
| 6,896,274 | B2 * | 5/2005 | Leslie | 280/87.042 |
| D524,400 | S | 7/2006 | Langford | |
| D529,565 | S | 10/2006 | Warner | |
| 7,314,223 | B2 * | 1/2008 | Lin | 280/87.042 |
| D561,288 | S | 2/2008 | Jordan | |
| 7,441,787 | B1 | 10/2008 | Jordan | |
| 2001/0048205 | A1 | 12/2001 | Schouten | |
| 2002/0011728 | A1 | 1/2002 | Osawa | |
| 2002/0089137 | A1 | 4/2002 | Chang | |
| 2002/0171217 | A1 * | 11/2002 | Sutherland | 280/87.042 |
| 2003/0107199 | A1 | 6/2003 | Descinkel | |
| 2003/0164269 | A1 * | 9/2003 | Attey | 188/19 |
| 2004/0032113 | A1 | 2/2004 | Ramcon | |
| 2004/0104551 | A1 * | 6/2004 | Jacobs | 280/87.042 |
| 2004/0155421 | A1 * | 8/2004 | Paddock | 280/87.042 |
| 2005/0280231 | A1 * | 12/2005 | Gallipoli | 280/87.042 |
| 2008/0284121 | A1 * | 11/2008 | French | 280/87.042 |
| 2009/0273150 | A1 * | 11/2009 | Kortschot | 280/11.223 |

* cited by examiner

*Primary Examiner* — J. Allen Shriver, II
*Assistant Examiner* — James Triggs
(74) *Attorney, Agent, or Firm* — Randal D. Homburg

(57) ABSTRACT

A three wheeled off road sports board provides a rider with the experience of snowboarding while traveling on dirt, gravel or other coarse surfaces, the sports board supplying a platform, a wheel secured within a cutout portion in the front of the board, and two rear wheels upon a common axle, with the rear end of the board providing an upward angled rear end with an adjustable lower braking apparatus to slow the rider and also to assist the rider in stopping, slowing or turning.

3 Claims, 3 Drawing Sheets

SPORTS BOARD WITH REAR BRAKE

CROSS REFERENCE TO RELATED APPLICATIONS

Reference is made to co-pending U.S. Design Pat. Application No. 29/315,280, filed by the same inventor, Christopher Jordan, on Jun. 1, 2009.

I. BACKGROUND OF THE INVENTION

1. Field of Invention

An off road sports board provides a rider with the experience of snowboarding while standing on the sports board and shifting his weight from side to side to steer the sports board on dirt, gravel or other particulate materials when or where snow is not present, the sports board having an overall elongated oval configured deck with an upward angled rear section and inward tapered central wheel cutouts, the sports board further defining an upper surface including a front and rear friction enhanced area upon which the rider's feet are positioned and secured by removable strappings, a front cutout section defining a front wheel opening and a lower surface to which are attached a pair axially aligned of front axle supports containing a front axle having a central portion upon which an inner bearing of a front wheel is placed, orienting the front wheel within the front cutout section, a pair of axially aligned middle axle supports containing a middle axle having two ends, each end attached to an inner bearing of a middle wheel, and an adjustable depth brake apparatus on the lower surface on the upward angled rear section, the rear friction enhances area located behind the middle axle allowing the rider to shift his weight, tilting upward angled rear section downward forcing the adjustable depth braking apparatus into the travel surface upon which the sports board is used, stopping or slowing the travel of the sports board.

2. Description of Prior Art

A preliminary review of prior art patents was conducted by the applicant which reveal prior art patents in a similar field or having similar use. However, the prior art inventions do not disclose the same or similar elements as the present sports board, nor do they present the material components in a manner contemplated or anticipated in the prior art.

In U.S. Pat. No. 6,270,096 to Cook, a portion of the wheels on the underside of a skateboard are presented in an in-line configuration, with Cook having two sets of three wheels with a steerable means on the truck. A snowboard is disclosed in U.S. Design Pat. No. D524,400 to Langford, disclosing a plurality of lower fins which allow for steering of the board by the angle of the upper deck.

U.S. Pat. No. 5,645,291 to Ramage, discloses a skateboard having oversized wheels for use on off-road terrains. In U.S. Pat. No. 5,096,225 to Osawa, a skateboard having plurality of reduced diameter rollers on the underside for use of the skateboard on grass is disclosed, the upper deck being flexible to conform to the varying terrain to allow all the wheels to remain in contact with the grass turf. In another U.S. Patent No. D529,565 to Warner, a skateboard with an arch shaped platform includes three sets of tandem wheels, one set on each end with a set in the middle.

A snowboard balance simulator is disclosed in U.S. Pat. No. 5,152,691 to Moscarello which has a single central roller base having a football shaped contour, but has no direct attachment to the upper board member. It is not intended for travel. In U.S. Pat. No. 6,698,776 to Todd, a skateboard with a snowboard response has contoured wheels, with two large diameter front and rear wheels affixed to the bottom of the board and two smaller diameter wheel located in front and behind the respective larger diameter wheels, demonstrating a tilting application indicated in FIG. 5, but requiring release of all pressure from the elevated end to accomplish the tilting movement.

Wheelless snowboard are shown in U.S. Patent Pub. No. 2004/0032113 to Rancon and Design Pat. No. D498,810, showing a similar board configuration which could be significantly modified for use as a component in the current sports board. A three wheeled board is shown in U.S. Pat. No. 3,630,540 to Smith, but it does not have two axial middle wheels and requires the rider to balance on two of the wheels without lateral stabilization. It also has no brake apparatus. U.S. Pat. No. 7,441,787 to Jordan (same inventor) includes three longitudinally aligned wheels with a front wheel, a rear wheel and a larger central wheel which is adjustable front to back. In U.S. Patent Pub. No 2003/0107199 to DeSchinkel, another longitudinally aligned set of three wheels is shown with foot clamps on the upper surface of the deck.

None of the disclosed indicates a sports board with a braking apparatus, a front wheel which is located in the front portion with the front wheel through the upper and lower deck and a middle axle with two axially aligned wheels on the sides of the board, providing a stabile sport board that can be stood upon without requiring a lateral balancing, the three wheels on the present sports board forming a triangular configuration and orientation, steerable by movement of weight by the rider from side to side with rear braking accomplished by a shift of weight to the back foot tilting the rear of the board, forcing the adjustable depth braking apparatus into the travel surface to slow or stop movement of the sports board upon the surface or to accentuate a turn.

II. SUMMARY OF THE INVENTION

Snowboarding has become an increasingly popular winter sport. Most of the country, however, does not have the capability of providing the appropriate environment for this activity to occur, either due to a lack of snow in that geographic region, or snow being unavailable during most of the warmer months of the year. Artificial snow has been provided to engage in this activity which costs a great deal of money to maintain and only limited use can be had because of space restrictions.

Oversized skateboards have also been provided which simulate snowboarding, but they are limited in their use to appropriate surfaces, either the streets, or a very fine dirt or sand. Theses boards usually have large diameter oversized wheels or provide the board with numerous lower wheels or a flexible upper deck.

The primary objective of the off-road sports board is to provide a board simulating the sport of snowboarding on a surface not covered in snow. A second objective is to provided the board with three wheels including a single front wheel and two axially aligned middle wheels for a stable platform, steered by the lateral shifting of weight. A third objective is to provide a brake with an adjustable depth braking apparatus.

III. DESCRIPTION OF THE DRAWINGS

The following drawings are submitted with this utility patent application.

IV. DESCRIPTION OF THE PREFERRED EMBODIMENT

Figure 1:
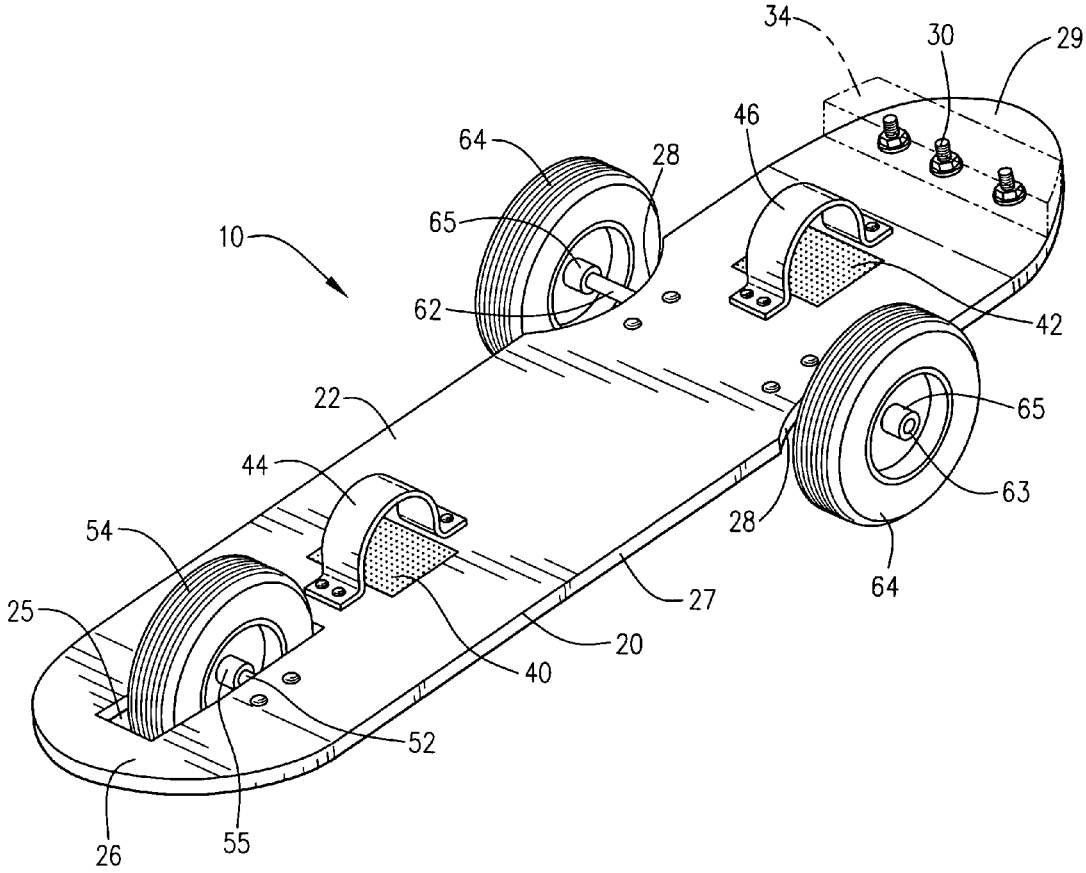
FIG. 1 is an upper perspective view of the three wheeled brake board.

A three wheeled recreational sports board 10, as shown in FIGS. 1-7, provides the experience of riding a snowboard on all terrain surfaces where snow is not present, the sports board 10 comprising a deck 20 having an overall elongated oval defining an upper surface 22, a lower surface 24, a front end 26, a front wheel cutout portion 25, two side margins 27, and an upward angled rear end 29, the upper surface 20 further providing a front and rear foot areas 40, 42 upon which a rider's feet would be placed when using the sports board 10 and a front removable strap 44 and rear removable strap 46 to secure the rider's feet to the sports board 10, the side margins 27 further defining inwardly contoured wheel indentations 28, the lower surface 24 further defining a pair of axially aligned front axle mounting brackets 50 securing an axially mounted front axle 52 upon which a central bearing 55 within a front wheel 54 with the front wheel 54 positioned within the front wheel cutout portion 25 of the deck 20 and a pair of axially aligned rear axle mounting brackets 60 securing a rear axle 62 having two ends 63, each end 63 upon which a central bearing 65 within a rear wheel 64 is affixed, each rear wheel 64 centrally aligned within a respective wheel indentation 28, and a braking apparatus 30 attached to the upward angled rear portion 29 through the upper and lower surface 22, 24 of the deck 20, having at least one contact 32 extending below the lower surface 24 to engage a travel surface upon which the sports board 10 is ridden by the rider shifting his weight to the upward angled rear end 29 of the upper surface 22 behind the rear axle 62, lowering the upward angled rear end 29 of the sports board 10 forcing the at least one contact 62 of the braking apparatus 30 into the travel surface, slowing or stopping the movement of the sports board 10.

Figure 2:
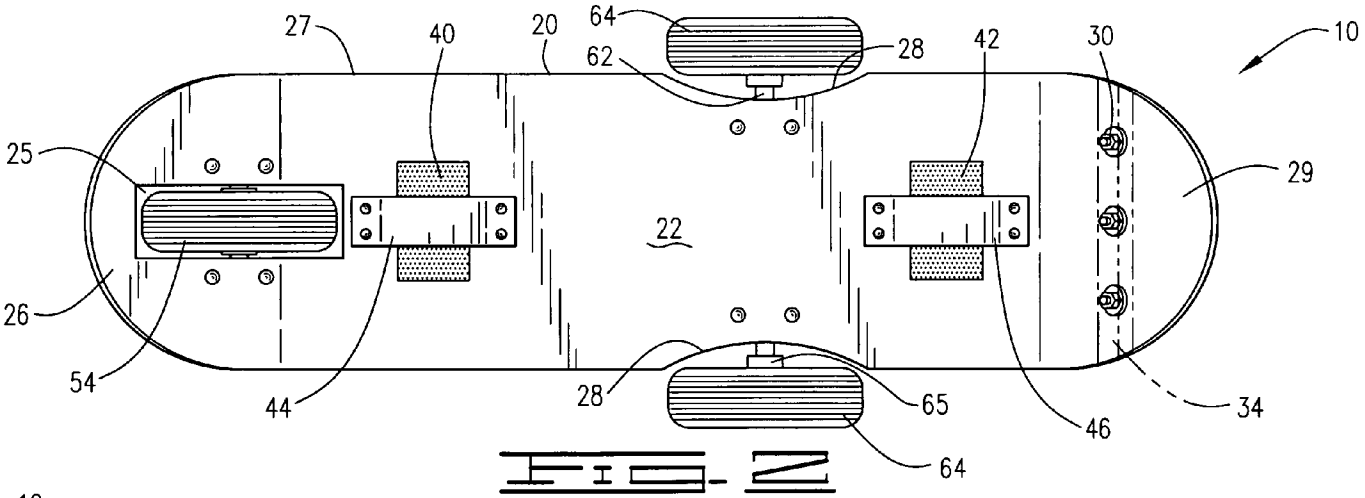
FIG. 2 is a top view of the three wheeled brake board.
Figure 3:
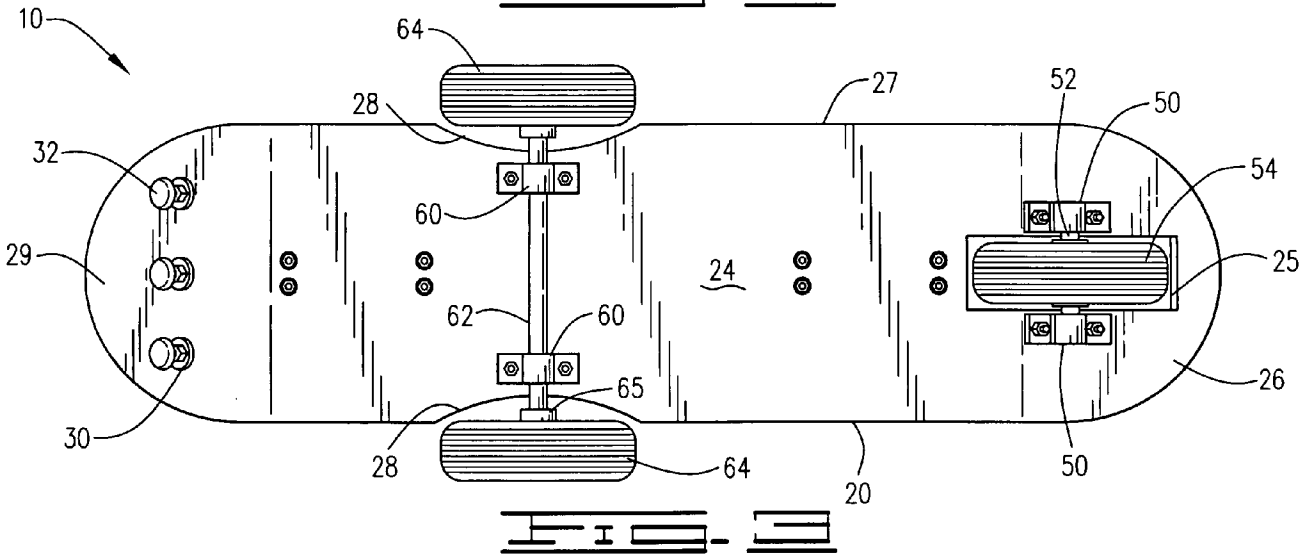
FIG. 3 is a bottom view of the three wheeled brake board.
Figure 4:
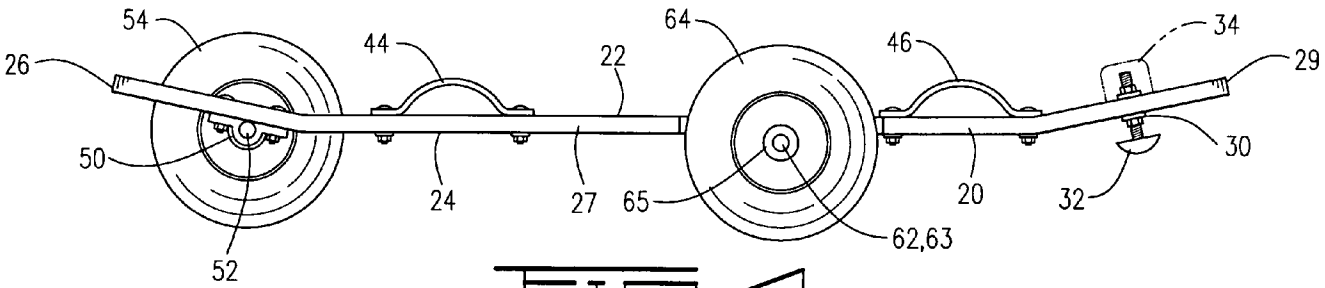
FIG. 4 is a left side view of the three wheeled brake board.

The front foot area 40 should be located behind the front wheel cutout portion 25, as indicated in FIGS. 1 and 2, and the rear foot area 42 should be located between the rear axle 62 and the upward angled rear end 29, indicated in FIGS. 1-3. The foot areas 40, 42, should include a friction enhanced surface, which can be accomplished by the application of sandpaper, rubber or by the application of an adhesive with a course grit material. The front and rear removable straps 44, 46, may be presented by a curved loop fabric attached to the deck over each respective front and rear foot area, FIGS. 1 and 4-5, and may be presented with a hook and loop connection and a two pieced strap, not shown, for quick adjustment and detachment.

The single front wheel 54 and the two rear wheels 64 in the triangular orientation as indicated in the drawing figures provide a stable support of the deck 20 when stationary, but also allows for the sports board 10 to be steered by the rider shifting weight from side to side, by a momentary elevation the front end of the board by a shifting of the rider's weight to the rear foot area 42, or by forcing the contact 32 of the braking apparatus 30 into the ground while applying a forceful twist, redirecting the front end 26 of the sports board into a different direction while pivoting on the rear wheels 64. The front and rear axle mounting brackets 50, 60, are shown as being bolted to the deck 20, but these may be attached in any permanent or removable manner. Additionally, the preferred disclosure indicates a fixed front and rear axle 52, 62, with the wheels 54, 64, rotating about the axles by a central wheel bearing 55, 65, but it is also contemplated that the axle may be rotationally contained within the respective mounting brackets with the wheel being attached to the rotating axle.

Figure 5:
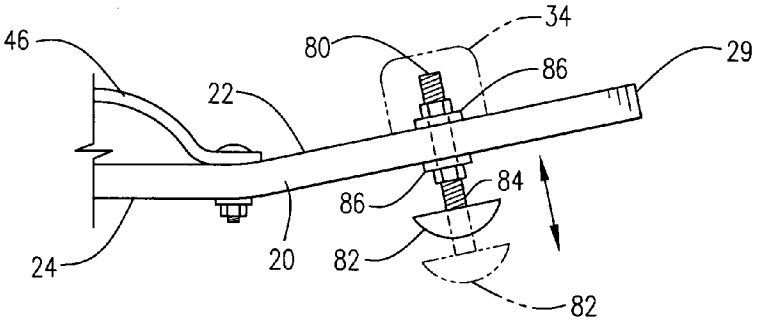
FIG. 5 is an isolated left side view of the rear section of the brake board indicating the adjustment of each brake bolt for varying terrain and travel surfaces.
Figure 7:
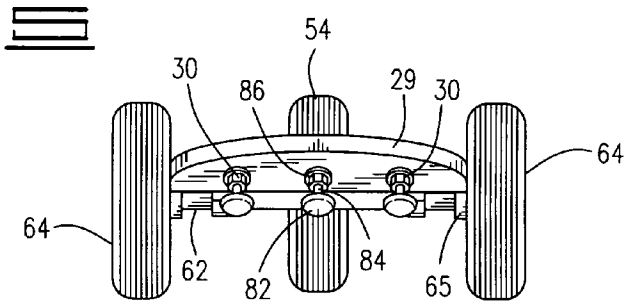
FIG. 7 is a rear end view of the three wheeled brake board.
Figure 6:
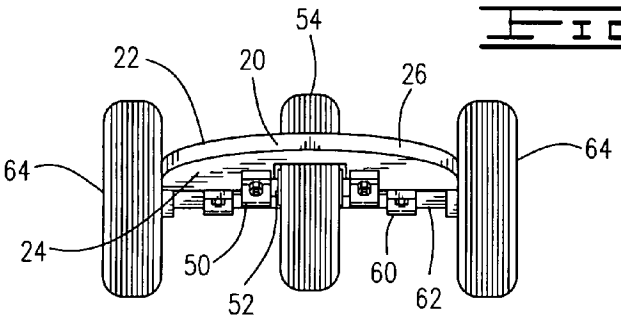
FIG. 6 is a front end view of the three wheeled brake board.

The braking apparatus 30 with at least one contact 32 may be at a fixed depth or may be provided with an adjustable depth with a single adjustable depth contact, not shown, or a plurality of adjustable depth contacts, indicated in the drawing figures. There may also be an upper guard 34 attached to an upper portion of each or all of the adjustable depth contacts to prevent the upper portions from injury to the rider during an accidental fall. One embodiment of the braking apparatus, as indicated in FIG. 5, would provide each contact 32 as an adjustable depth contact defining a threaded bolt 80 with a bolt head 82 extending below the lower surface 24 and a threaded shaft 84 inserted through the deck 20, with a washer and nut 86 attached to the threaded shaft 84 below the lower surface 24 and another washer and nut 86 attached to the threaded shaft 84 above the upper surface 22, the washers and nuts 86 being tightened against the deck 20 when a the bolt head 82 is at a desired position below the upward angle rear end 29. The depth would be preferable adjustable because of the variety of terrains the sports board 10 may be ridden upon. For example, a longer depth may be preferred when traveling upon a loose dirt of gravel surface, while a shorter depth would be preferred on a more compact surface, such as asphalt or a parking lot. Riders may prefer more or less braking, or none at all, in which case the adjustable depth contact 32 may be at it shortest possible depth. Other embodiments of the braking apparatus may include a flared metal bracket bolted to the lower surface, and piece of angle metal bolted to the lower surface, a curved claw or hook attached to the lower surface, or any solid object extending from the lower surface that would provide some type of ground contact or friction to slow or stop travel other than the lower surface of the deck on the upward angled rear end.

While the sports board 10 with a braking apparatus has been particularly shown and described with reference to a preferred embodiment thereof, it will be understood by those skilled in the art that changes in form and detail may be made therein without departing from the spirit and scope of the sports board 10.

What is claimed is:

1. A three-wheeled recreational sports board, providing an experience of riding a snowboard on all terrain surfaces where snow is not present, said sports board comprising:

a deck having an overall elongated oval defining an upper surface, a lower surface, a front end, a front wheel cutout portion, two side margins providing inwardly contoured wheel indentations, and an upward angled rear end;

a front foot area and a rear foot area, a front removable strap and rear removable strap over each respective said front foot area and said rear foot area;

a pair of axially aligned front axle mounting brackets securing an axially mounted front axle upon which a central bearing within a front wheel with said front wheel positioned within said front wheel cutout portion of said deck;

a pair of axially aligned rear axle mounting brackets securing a rear axle having two ends, each end upon which a central bearing within a rear wheel is affixed, each rear wheel centrally aligned within a respective wheel indentation; and a braking apparatus attached to said upward angled rear portion end through said upper and lower surface of said deck having at least one contact extending below said lower surface to engage a travel surface upon which said sports board is ridden by a rider shifting his weight to said upward angled rear end behind said rear axle, lowering said upward angled rear end of said sports board and forcing said at least one contact of said braking apparatus into the travel surface, slowing or stopping the movement of said sports board, said sports board further steerable by a shifting of weight from side to side by the rider.

2. The sports board, as disclosed in claim 1, further comprising:

said front foot area is located behind the front wheel cutout portion and said rear foot area is located between said rear axle and said upward angled rear end;

said front foot area and said rear foot area provide a friction enhanced surface; and said front and rear removable straps are a curved loop fabric attached to the deck over each respective front and rear foot area.

3. The sports board, as disclosed in claim 1, further comprising:

said braking apparatus provides a plurality of adjustable depth contacts, each adjustable depth contact defining a threaded bolt with a bolt head extending below said lower surface and a threaded shaft inserted through said deck, a washer and nut attached to said threaded shaft below said lower surface and another washer and nut attached to said threaded shaft above said upper deck, said bolts being tightened against said deck when said bolt head is at a desired position below said upward angle rear end, said depth adjustable to a variety of terrains upon which said sports board may be ridden.

* * * * *